US011505998B2

(12) United States Patent
Morin

(10) Patent No.: US 11,505,998 B2
(45) Date of Patent: Nov. 22, 2022

(54) EARTH-BORING TOOL GEOMETRY AND CUTTER PLACEMENT AND ASSOCIATED APPARATUS AND METHODS

(71) Applicant: Baker Hughes Oilfield Operations LLC, Houston, TX (US)

(72) Inventor: John Morin, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/071,844

(22) Filed: Oct. 15, 2020

(65) Prior Publication Data

US 2022/0120139 A1 Apr. 21, 2022

(51) Int. Cl.
*E21B 10/43* (2006.01)
*E21B 10/14* (2006.01)
*E21B 10/18* (2006.01)

(52) U.S. Cl.
CPC ..... *E21B 10/43* (2013.01); *E21B 10/14* (2013.01); *E21B 10/18* (2013.01)

(58) Field of Classification Search
CPC ..... E21B 10/43; E21B 10/627; E21B 10/633
See application file for complete search history.

(56) References Cited

U.S. PATENT DOCUMENTS 10,557,318 B2 2/2020 Slavens et al.
10,662,714 B2 * 5/2020 Cunningham ..... E21B 10/00
10,914,123 B2 * 2/2021 Russell ..... E21B 10/602
11,066,875 B2 * 7/2021 Russell ..... E21B 10/43
2010/0089661 A1 4/2010 Welch et al.
2011/0030509 A1 * 2/2011 Stevens ..... E21B 10/43 76/108.4
2011/0192651 A1 8/2011 Lyons et al.
2013/0292185 A1 11/2013 Knull et al.
2016/0084010 A1 * 3/2016 Beaton ..... E21B 10/55 175/432
2019/0271194 A1 * 9/2019 Russell ..... E21B 10/43
2019/0316420 A1 10/2019 Russell et al.

FOREIGN PATENT DOCUMENTS

EP 3000959 A1 8/2011
WO 2019/168905 A1 12/2021

OTHER PUBLICATIONS

International Search Report for International Application No. PCT/US2021/045980 dated Dec. 8, 2021, 3 pages.
International Written Opinion for International Application No. PCT/US2021/045980 dated Dec. 8, 2021, 6 pages.

* cited by examiner

*Primary Examiner* — Blake Michener
(74) *Attorney, Agent, or Firm* — TraskBritt

(57) ABSTRACT

An earth-boring tool may include at least one blade including a shoulder region and a face. A plurality of cutting elements may be arranged on the face of the blade and at least one cutting element may be positioned in the shoulder region such that a cutting face of the at least one cutting element is spaced a distance behind the face of the blade. A recessed portion of the blade may extend under at least one of the plurality of cutting elements arranged on the face of the blade and extending to the at least one cutting element positioned in the shoulder region.

20 Claims, 7 Drawing Sheets

EARTH-BORING TOOL GEOMETRY AND CUTTER PLACEMENT AND ASSOCIATED APPARATUS AND METHODS

TECHNICAL FIELD

Embodiments of the present disclosure generally relate to earth-boring operations. In particular, embodiments of the present disclosure relate to earth-boring tool geometry and cutter placement and associated apparatus and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

Earth-boring tools may include cutting structures formed from abrasive materials having high hardness characteristics. The cutting structures may be configured to engage the formations and additional elements to remove material therefrom. As the cutting structures engage the formations and additional elements, debris (e.g., chips, cuttings, loose material, etc.) significant amounts of heat may be generated. If the debris and heat are not dissipated they may contribute to premature failure of the cutting structures, requiring the earth-boring tool to be removed for repair and or replacement. This may result in significant losses of time, reducing the efficiency and increasing the costs of a drilling operation.

BRIEF SUMMARY

Embodiments of the present disclosure may include an earth-boring tool. The earth-boring tool may include at least one blade including a shoulder region and a face. The earth-boring tool may further include a plurality of cutting elements arranged on the face of the blade. The earth-boring tool may also include at least one cutting element positioned in the shoulder region such that a cutting face of the at least one cutting element is spaced a distance behind the face of the blade. The earth-boring tool may further include a recessed portion of the blade extending under at least one of the plurality of cutting elements arranged on the face of the blade and extending to the at least one cutting element positioned in the shoulder region.

Another embodiment of the present disclosure may include an earth-boring tool. The earth-boring tool may include at least two blades extending from an earth-boring tool body. The earth-boring tool may further include a junk slot between the at least two blades. The earth-boring tool may also include one or more cutter pockets formed in a face of the at least two blades. The earth-boring tool may further include at least one cutter pocket formed in a shoulder portion of at least one of the at least two blades, the at least one cutter pocket formed a distance from the face of the at least one blade. The earth-boring tool may also include a recess connecting the at least one cutter pocket formed in the shoulder portion of the at least one blade to the junk slot. The recess may extend under an outer cutter pocket of the one or more cutter pockets formed in the face of the at least two blades.

Another embodiment of the present disclosure may include a method of forming an earth-boring tool. The method may include forming a tool body including one or more blades and cutter pockets defined in a surface of the one or more blades. The cutter pockets may be defined in at least a face of the one or more blades and a shoulder region of the one or more blades spaced a distance from the face of the one or more blades. The method may further include forming a junk slot in an area of the tool body proximate the face of the one or more blades. The method may also include forming a nozzle within the junk slot configured to supply a fluid into the junk slot. The method may further include forming a recess extending at an angle from the face of the one or more blades to at least one of the cutter pockets defined in the shoulder region of the one or more blades. The recess may be under at least one of the cutter pockets defined in the face of the one or more blades.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
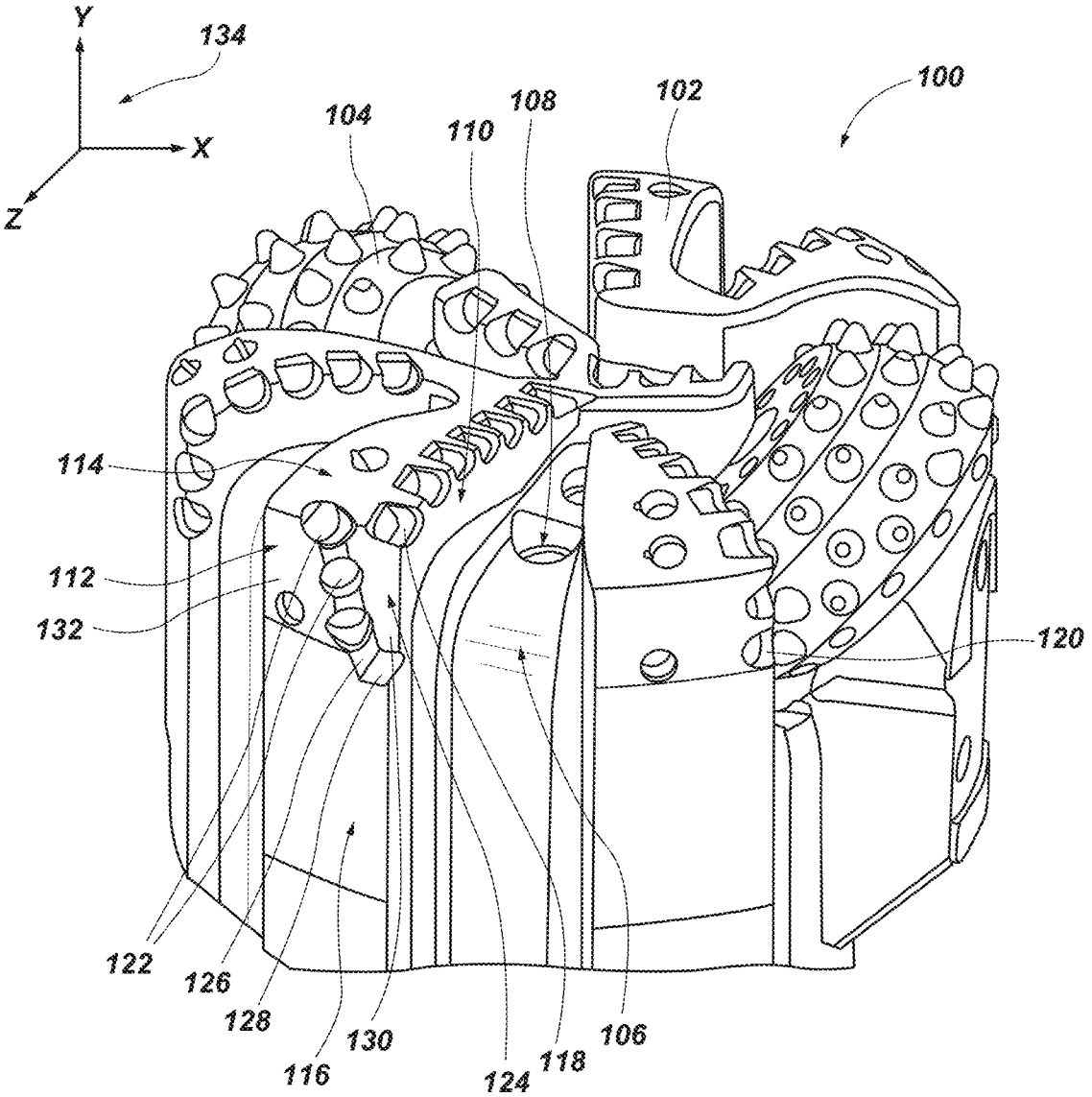
FIG. 1 illustrates a perspective view of an earth-boring tool in accordance with an embodiment of the present disclosure.

The illustrations presented herein are not meant to be actual views of any particular earth-boring system or component thereof, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, terms such as ahead and behind are used in reference to a direction of movement of the associated element. For example, as a drill string moves into a borehole the bottom of the borehole is ahead of the elements of the drill string and the surface is behind the elements of the drill string. In another example, in relation to a cutting element on a rotating earth-boring tool a portion of the formation that has not yet been contacted by the cutting element is ahead of the cutting element whereas a portion of the formation that has already been contacted by the cutting element is behind the cutting element.

As used herein, the term "and/or" means and includes any and all combinations of one or more of the associated listed items.

As used herein, the terms "vertical" and "lateral" refer to the orientations as depicted in the figures.

Earth-boring tools may include cutting structures, such as cutting elements or cutters formed from abrasive materials having high hardness characteristics. The cutting structures may be configured to engage the formations and additional elements to remove material therefrom. As the cutting structures engage the formations and additional elements, debris (e.g., chips, cuttings, loose material, etc.) the cutting structures wear and eventually must be replaced. Replacing the cutting structures may require the earth-boring tool to be removed from the associated wellbore. Increasing the number of cutting structures in an area of the earth-boring tool may reduce the load on each cutting structure, increasing the amount of time before the cutting structures must be replaced. Fluid may be flowed over the cutting structures to clear debris from the cutting structures and cool the cutting structures to further increase the cutting life of the cutting structures.

FIG. 1 illustrates an embodiment of an earth-boring tool 100. The earth-boring tool 100 may include one or more blades 102 arranged about the body of the earth-boring tool 100. As illustrated in FIG. 1, the earth-boring tool 100 may be a hybrid bit including blades 102 and roller cones 104. In some embodiments, the earth-boring tool 100 may only include roller cones 104, such as a roller cone bit, or the earth-boring tool 100 may only include blades 102, such as a drag bit. The blades 102 and/or roller cones 104 may be separated by junk slots 106. The junk slots 106 may include nozzles 108. The nozzles 108 may be configured to supply a fluid (e.g., discharge a fluid), such as water, drilling mud, etc., into the junk slots 106.

The blades 102 may include a face 110 and a shoulder region 112. The face 110 may be oriented to face the area ahead of the blade 102 and the shoulder region 112 may be a radially outer region of the blade 102 in a transition between a nose region 114 and a gage region 116 of the blade 102. The blade 102 may include multiple cutter pockets 118 formed along an edge of the face 110 of the blade 102. The cutter pockets 118 may be configured to receive cutting elements, such as polycrystalline diamond compact (PDC) cutting elements. The cutting elements may be arranged such that a cutting face of the cutting elements are in substantially the same plane as the face 110 of the blade 102. The fluid flowing from the nozzles 108 may be configured to clear debris and formation materials away from the cutting elements and face 110 of the blade 102 as well as cooling the cutting elements. The shoulder region 112 of at least some of the blades 102 may include shoulder cutter pockets 120. The shoulder cutter pockets 120 may also be configured to receive cutting elements. In some cases, the cutting elements may be arranged such that a cutting face of the cutting elements are in substantially the same plane as the face 110 of the blade 102.

One or more of the blades 102 may include recessed shoulder cutter pockets 122. The recessed shoulder cutter pockets 122 may be defined in the outer surface of the shoulder region 112 a distance behind the face 110 of the blade 102. The recessed shoulder cutter pockets 122 may be configured to receive cutting elements. Due to the distance between the face 110 of the blade 102 and the recessed shoulder cutter pockets 122, the cutting faces of the cutting elements arranged in the recessed shoulder cutter pockets 122 may be a distance behind the face 110 of the blade 102. The surface of the blade 102 in the shoulder region 112 ahead of the recessed shoulder cutter pockets 122 may form a recess 124 such that the cutting faces of the cutting elements arranged in the recessed shoulder cutter pockets 122 may engage the formation. The recess 124 may be defined by a recessed cutter wall 126, a shelf 128, and a recessed surface 130. The recess 124 may be recessed by a distance at least the same as a diameter of the cutting faces of the cutting element arranged in the recessed shoulder cutter pockets 122. For example, the distance between an outer surface 132 of the shoulder region 112 of the blade 102 and the recessed surface 130 may be between about 0.090 inches (in) (2.286 millimeters (mm)) and about 1 in (25.4 mm), such as between about 0.25 in (6.35 mm) and about 0.75 in (19.05 mm), or about 0.5 in (12.7 mm).

The recessed shoulder cutter pockets 122 may be arranged on a recessed cutter wall 126. The recessed cutter wall 126 may extend at an angle relative to the face 110 of the blade 102. Arranging the recessed shoulder cutter pockets 122 on the recessed cutter wall 126 at an angle relative to the face 110 of the blade 102 may enable more cutting elements and/or cutting surface area to be positioned in the same region of the blade 102. For example, as illustrated in FIG. 1, the blades 102 with standard shoulder cutter pockets 120 may have two shoulder cutter pockets 120 whereas the blades 102 having the recessed shoulder cutter pockets 122 may have three recessed shoulder cutter pockets 122 in the same region of the cutting plane. Having more cutting elements may decrease the amount of material being removed by each individual cutting element increasing the life of the cutting elements. In some cases, having more cutting elements in the shoulder region 112 may generate more side cutting force that may improve control of the earth-boring tool 100, such as steerability, responsiveness to different formation materials, etc.

The shelf 128 may extend from the face 110 in a substantially perpendicular direction. The recessed cutter wall 126 may intersect the shelf 128 a distance from the face 110 of the blade 102. The recessed cutter wall 126 may extend from the shelf 128 at an angle relative to both the shelf 128 and the face 110 of the blade 102. For example, the face 110 of the blade 102 may reside in a plane that is substantially aligned in a y direction, as defined in coordinate system 134. The coordinate system 134 may be defined such that the y direction is substantially aligned with the central axis of the earth-boring tool 100, the x direction is in a rotational direction of the earth-boring tool 100, and the z direction is a radial direction extending away from the central axis of the earth-boring tool 100. The shelf 128 may extend from the face 110 in the x direction. The recessed cutter wall 126 may extend from the shelf 128 at an angle between the x direction and the y direction, such that the recessed cutter wall 126 may extend at an angle less than about 90° from the y direction and less than about 90° from the x direction. The angle formed between the recessed cutter wall 126 and the shelf 128 may be between about 90° and about 180°, such as between about 90° and about 135°, or between about 110° and about 130°.

Figure 2:
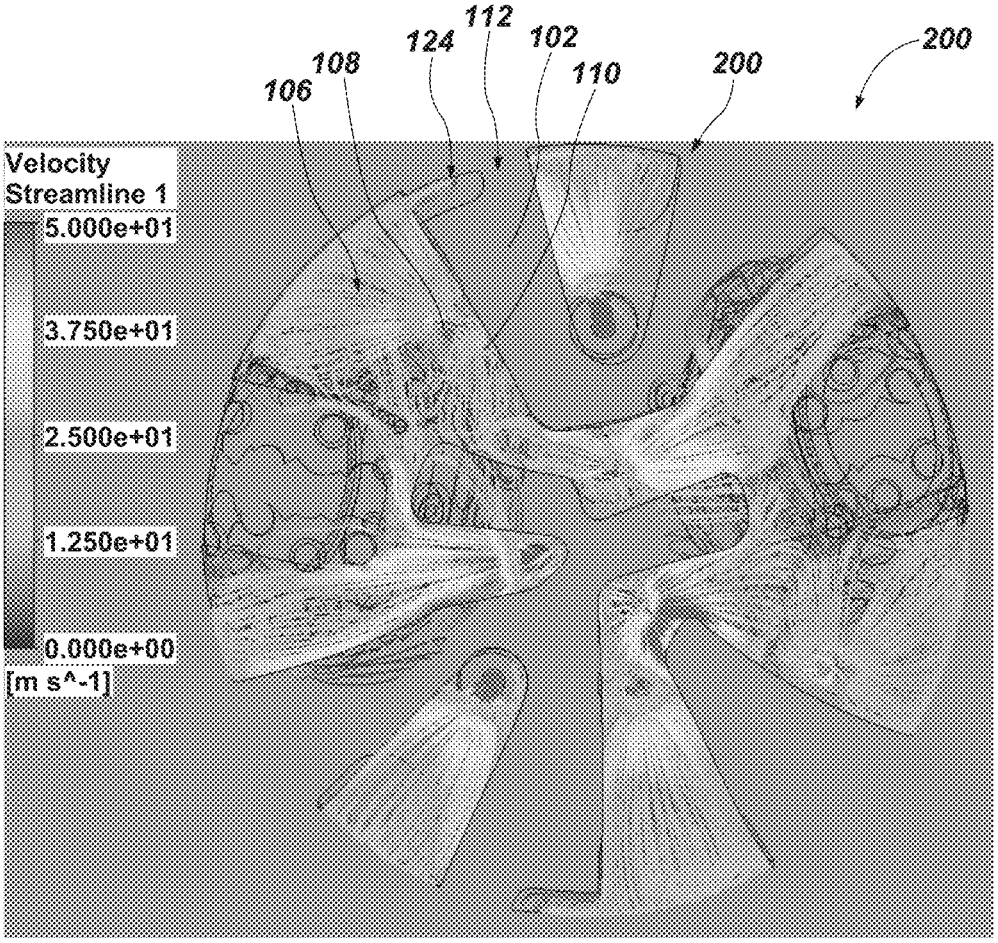
FIG. 2 illustrates a hydraulic flow diagram of the earth-boring tool of FIG. 1 in accordance with an embodiment of the present disclosure.

FIG. 2 illustrates a flow diagram 200 of the earth-boring tool 100 of FIG. 1. The flow diagram 200 illustrates flow of the fluid from the nozzles 108 into the junk slots 106. As illustrated in FIG. 2, the velocity of the fluid may be highest at the nozzle 108 and the velocity may dissipate as the fluid flows through the junk slots 106. In the higher velocity areas fluid may clear debris from around the elements of the earth-boring tool 100, substantially preventing premature wear due to debris build up. The higher velocity fluid may also dissipate heat from the elements of the earth-boring tool 100, substantially preventing premature wear and/or failure due to overheating.

As illustrated in FIG. 2, the fluid velocities may be substantially lower in the recess 124 portion of the shoulder region 112 of the blade 102. For example, the recess 124 may result in stagnated fluid flow, such that when fluid enters the recess 124 the fluid may not circulate and exit the recess 124. Thus, the fluid may become trapped or stagnated in the recess 124. The low fluid velocities and/or stagnated fluid may result in debris build up and/or overheating of the cutting elements in the recessed shoulder cutter pockets 122. Debris build-up may reduce the efficiencies of the cutting elements resulting in less material removal and higher cutting element temperatures. Overheating may cause the cutting elements to wear faster and/or experience damage, such as cracking, chipping, galling, etc. When the cutting elements wear out or are damaged the earth-boring tool 100 may be tripped out of the wellbore to repair the earth-boring tool 100 and/or replace the worn or damaged cutting elements. Tripping out the earth-boring tool 100 may take multiple days to complete resulting in lost time and productivity as well as the cost of running the drilling operation for the multiple days to trip out the earth-boring tool 100.

Figure 3:
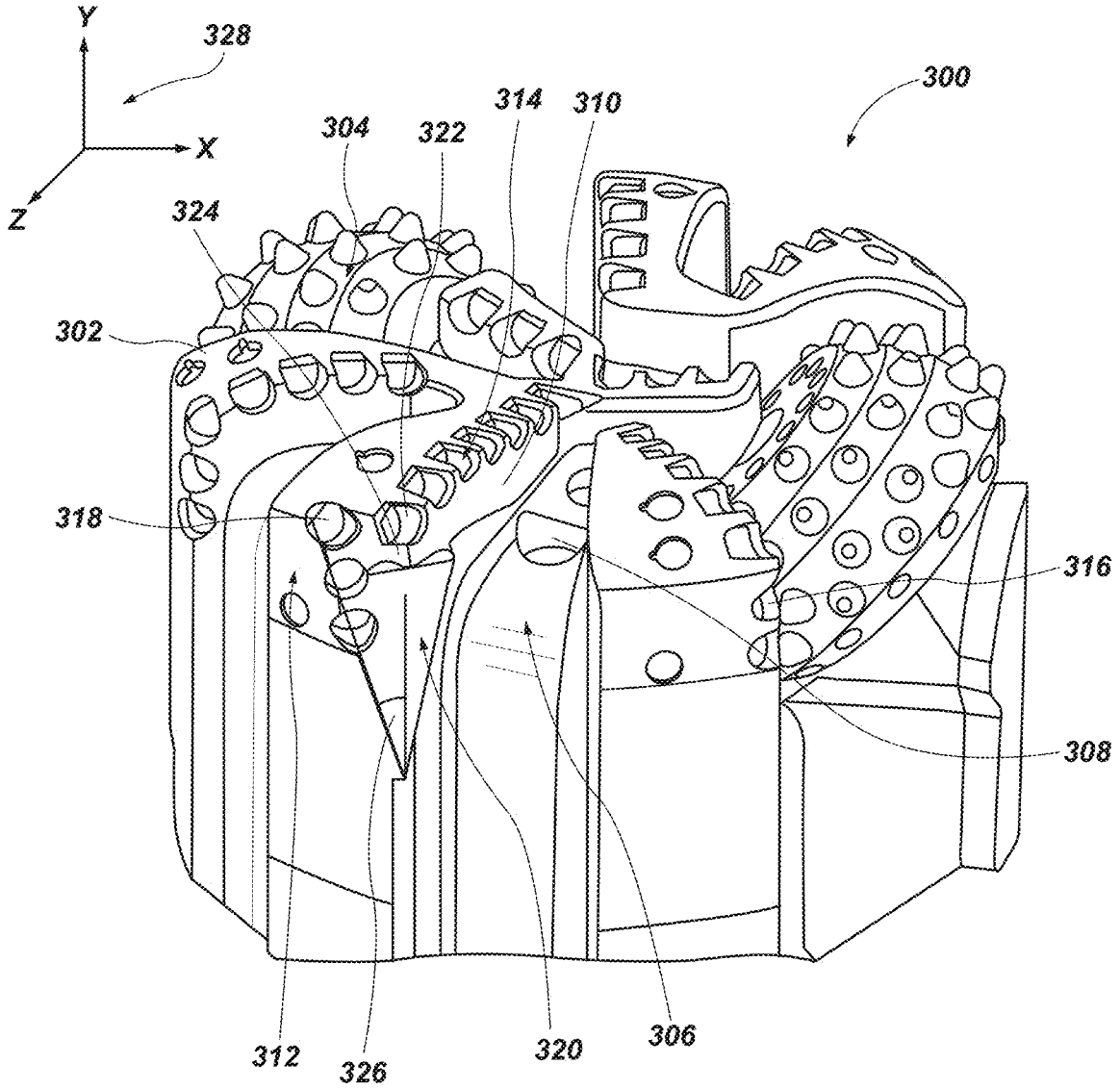
FIG. 3 illustrates a perspective view of an earth-boring tool in accordance with an embodiment of the present disclosure.

FIG. 3 illustrates an embodiment of an earth-boring tool 300. While the earth-boring tool 300 is illustrated as a hybrid drill bit including multiple blades 302 and roller cones 304, it is noted that the cutter arrangements and designs discussed herein may be incorporated into any earth-boring tool including fixed cutters mounted to blades, such as fixed-cutter bits, eccentric bits, bicenter bits, reamers, mills, drag bits, hybrid bits, and other drilling bits and tools known in the art.

The blades 302 may define junk slots 306 between the blades 302. The junk slots 306 may include nozzles 308 configured to supply fluid, such as, water, drilling mud, etc., into the junk slots 306 for clearing cuttings and debris from the blades 302 and dissipating heat from the blades 302 and the components thereof. The blades 302 may include a face 310, a shoulder region 312, and multiple cutter pockets 314 formed thereon. Many of the cutter pockets 314 may be formed on the blades 302 such that cutting elements secured in the cutter pockets 314 may be positioned such that a cutting face of the cutting elements is substantially co-planar (e.g., in substantially the same plane) with the face 310 of the respective blade 302. Some of the cutter pockets 314 may be positioned on the shoulder region 312. For example, the shoulder region 312 may include multiple shoulder cutter pockets 316 positioned such that the cutting faces of the cutting elements secured to the shoulder cutter pockets 316 may be substantially co-planar with the face 310 of the respective blade 302.

Some blades 302 may include recessed shoulder cutter pockets 318 positioned such that the cutting faces of the cutting elements secured thereto are spaced a distance behind the face 310 of the respective blade 302. The recessed shoulder cutter pockets 318 may be arranged such that the recessed shoulder cutter pockets 318 are in a linear relationship at an angle 326 relative to the face 310 of the blade 302. A coordinate system 328 may be defined such that they direction is substantially aligned with the central axis of the earth-boring tool 100, the x direction is in a rotational direction of the earth-boring tool 100, and the z direction is a radial direction extending away from the central axis of the earth-boring tool 100. The angle 326 between the linear relationship of the recessed shoulder cutter pocket 318 and the face 310 of the blade 302 may extend between the x direction and the y direction. As described above, arranging the recessed shoulder cutter pocket 318 at an angle may enable a larger number of cutting elements to be arranged within the same facial area of the blade 302. The angle 326 between the linear relationship of the recessed shoulder cutter pockets 318 and the face 310 of the blade 302 may be between about 20 degrees and about 45 degrees, such as between about 40 degrees and about 30 degrees, or about 33 degrees.

The blades 302 including recessed shoulder cutter pockets 318 may include a recess 320 passing between the face 310 of the blade 302 to the shoulder region 312 of the blade 302 configured to provide a flow path for the fluid from the junk slot 306 to the recessed shoulder cutter pockets 318 by connecting the junk slot 306 to the recessed shoulder cutter pockets 318. The recess 320 may extend beneath at least one outer cutter pocket 322 on the blade 302, such that the portion of the blade 302 supporting the outer cutter pocket 322 forms a ledge 324 extending over the recess 320.

Figure 4:
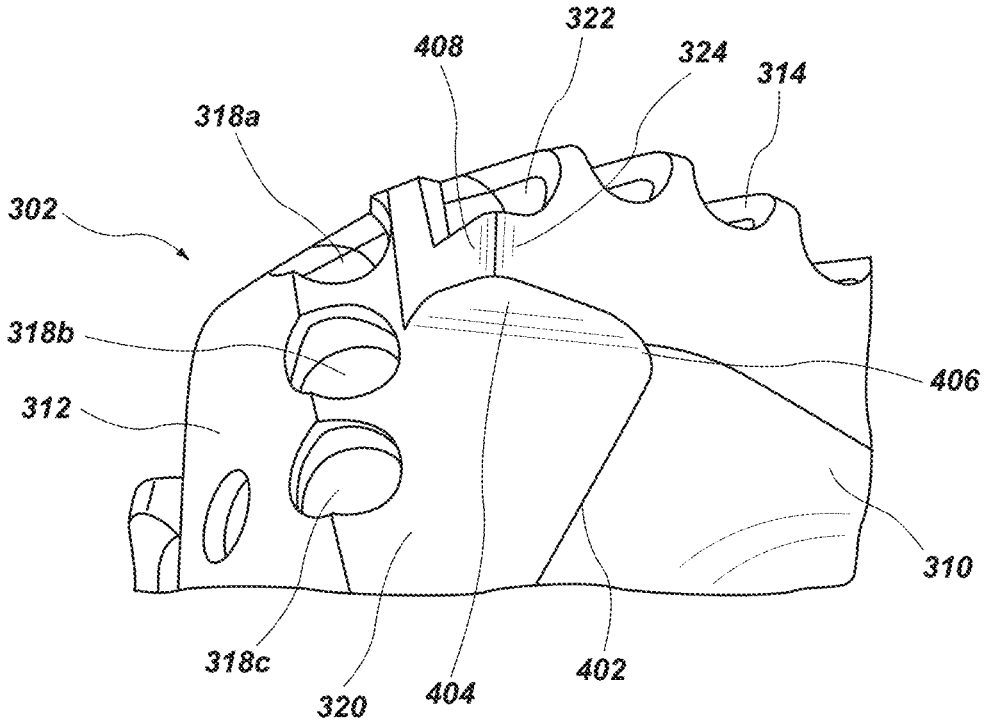
FIG. 4 illustrates an enlarged view of a shoulder region of the earth-boring tool of FIG. 3 in accordance with an embodiment of the present disclosure.

FIG. 4 illustrates an enlarged view of the recessed shoulder cutter pockets 318 on the blade 302. In some embodiments, the recess 320 may include a substantially planar (e.g., straight, flat, etc.) surface that may extend at an angle relative to the face 310 of the blade 302. For example, a transition region 402 between the recess 320 and the face 310 of the blade 302 may form an angle. The recess 320 may maintain the angle until the surface of the recess 320 reaches the shoulder region 312 proximate the recessed shoulder cutter pockets 318. In some embodiments, the transition region 402 may be a hard angle (e.g., a linear edge). In other embodiments, the transition region 402 may be a gradual transition, such as a chamfer, radiused edge, rounded edge, etc. In some embodiments, the recess 320 may be curved such that the recess 320 may be substantially co-planar with the face 310 at a transition region 402 and the recess 320 and may be substantially perpendicular to the face 310 in an area proximate the recessed shoulder cutter pockets 318.

In some embodiments, the transition region 402 between the face 310 of the blade 302 and the recess 320 may extend at an angle downward from a transition region 406 between the recess 320 and the ledge 324 to the shoulder region 312 of the earth-boring tool 300. For example, the shoulder region 312, the transition region 402 between the recess 320 and the face 310 of the blade 302, and the transition region 406 between the recess 320 and the ledge 324 may define a substantially triangular surface.

The ledge 324 may extend over the recess 320, such that the outer cutter pocket 322 supported by the ledge 324 may be positioned over the recess 320. The outer cutter pocket 322 may be configured to position a cutting element such that a cutting path (e.g., path of the cutting face of the cutting element) is proximate a cutting path of a cutting element positioned in the first recessed shoulder cutter pocket 318*a*. The bottom surface 404 of the ledge 324 may be substantially aligned with a top portion of the second recessed shoulder cutter pocket 318*b*.

In some embodiments, the recess 320 may extend in a plane of the first recessed shoulder cutter pocket 318*a*, such that the recess 320 may provide a larger area enabling more fluid to flow to the recessed shoulder cutter pockets 318 as the first recessed shoulder cutter pocket 318*a* is the most recessed shoulder cutter pocket 318. In other embodiments, the recess 320 may extend in a plane of the second or third recessed shoulder cutter pockets 318*b*, 418*c*. For example, to enable a thickness of the ledge 324 to be sufficient to support the outer cutter pocket 322, the recess 320 may be positioned in the plane of the second recessed shoulder cutter pocket 318*b* or the third recessed shoulder cutter pocket 318*c* which may be positioned at lower vertical position than the first recessed shoulder cutter pocket 318*a*.

The ledge 324 may have a thickness (e.g., a distance between the outer cutter pocket 322 and the bottom surface 404 of the ledge 324) sufficient to support the cutting element mounted in the outer cutter pocket 322 under the loads present when drilling the formation. For example, the ledge 324 may have a thickness of greater than about 0.25 in (6.35 mm), such as between about 0.25 in (6.35 mm) and about 0.5 in (12.7 mm) or between about 0.25 in (6.35 mm) and about 0.4 in (10.16 mm). In some embodiments, the structure of the ledge 324 may provide further support. For example, the transition region 406 between the bottom surface 404 of the ledge 324 and the recess 320 may include a chamfer or curve configured to strengthen the ledge 324. In some embodiments, the bottom surface 404 of the ledge 324 may extend at an angle relative to the recess 320, such that the ledge 324 has a greater thickness at the transition region 406 than the thickness at an outer surface 408 of the ledge 324. In some embodiments, the ledge 324 may include additional structures such as gussets, ridges, etc., extending from the recess 320 to the bottom surface 404 of the ledge 324 to provide additional support to the ledge 324.

The outer surface 408 of the ledge 324 may be recessed from the shoulder region 312 of the blade 302 by a distance substantially the same as or greater than a diameter of the cutting face of the cutting element secured in the first recessed shoulder cutter pocket 318*a*. For example, the outer surface 408 of the ledge 324 may be recessed by between about 0.090 in (2.286 mm) and about 1 in (25.4 mm), such as between about 0.25 in (6.35 mm) and about 0.75 in (19.05 mm), or about 0.5 in (12.7 mm).

As described above, the recessed shoulder cutter pockets 318*a*, 318*b*, 318*c* may be recessed a distance from the face 310 of the blade 302 and may be linearly arranged at an angle relative to the face 310 of the blade 302. Thus, the distance between the first recessed shoulder cutter pocket 318*a* and the face 310 may be greater than a distance between the third recessed shoulder cutter pocket 318*c* and the face 310. Thus, the cutting element secured in the third recessed shoulder cutter pocket 318 may define the smallest distance between the associated cutting face and the face 310. The distance between the cutting face of the cutting element secured in the third recessed shoulder cutter pocket 318 and the face 310 of the blade 302 may be substantially equal to or greater than a depth of the cutter pockets 314 in the blade 302. For example, the distance between the cutting face and the face 310 of the blade 302 may be greater than about 0.125 in (3.175 mm), such as between about 0.125 in (3.175 mm) and about 2.80 in (71.12 mm).

In some embodiments, the recessed shoulder cutter pockets 318 may be configured to position the cutting elements secured therein such that the cutting faces are oriented at an angle to the cutting plane (e.g., with a backrake angle or siderake angle). For example, the cutting elements may be positioned such that the cutting faces are at an angle relative to the vertical plane (e.g., angle relative to the longitudinal axis of the earth-boring tool 100), commonly referred to in the art as a backrake angle. The recessed shoulder cutter pocket 318 may position the associated cutting elements at a backrake angle of between about 0° and about 50°, such as between about 15° and about 45°. In some embodiments, the cutting elements may be positioned such that the cutting faces are at an angle relative to a radial plane (e.g., angle relative to a radial line extending along the blade 302), commonly referred to in the art as a siderake angle. In some embodiments, the recessed shoulder cutter pocket 318 may position the associated cutting element at a siderake angle of between about −20° and about 20°, such as between about −10° and about 10°.

In some embodiments, portions of the earth-boring tool 300 may include hardfacing. Hardfacing may include a high hardness or wear resistant coating or treatment over surfaces of the earth-boring tool 300. For example, surfaces most likely to contact the formation or cuttings from the formation may include hardfacing material to reduce the amount of wear of the respective surfaces of the earth-boring tool 300. Surfaces that may include hardfacing may include the surface of the recess 320 and/or the surfaces of the blade 302, such as the face 310 and the shoulder region 312.

In some embodiments, the recess 320 may have a substantially smooth surface (e.g., a surface without ridges, valleys, bumps, etc.). The substantially smooth surface may enable increases fluid flow into the recess 320 and over the cutting elements secured in the recessed shoulder cutter pockets 318.

In some embodiments, the recess 320 may be formed in the same process as the earth-boring tool 300 is formed, such as a molding or forging process. For example, the mold or form used to form the earth-boring tool 300 may include features corresponding to the recess 320. In some embodiments, the recess 320 may be cut into the blade 302 after the earth-boring tool 300 is formed, such as through a machining process.

Figure 5:
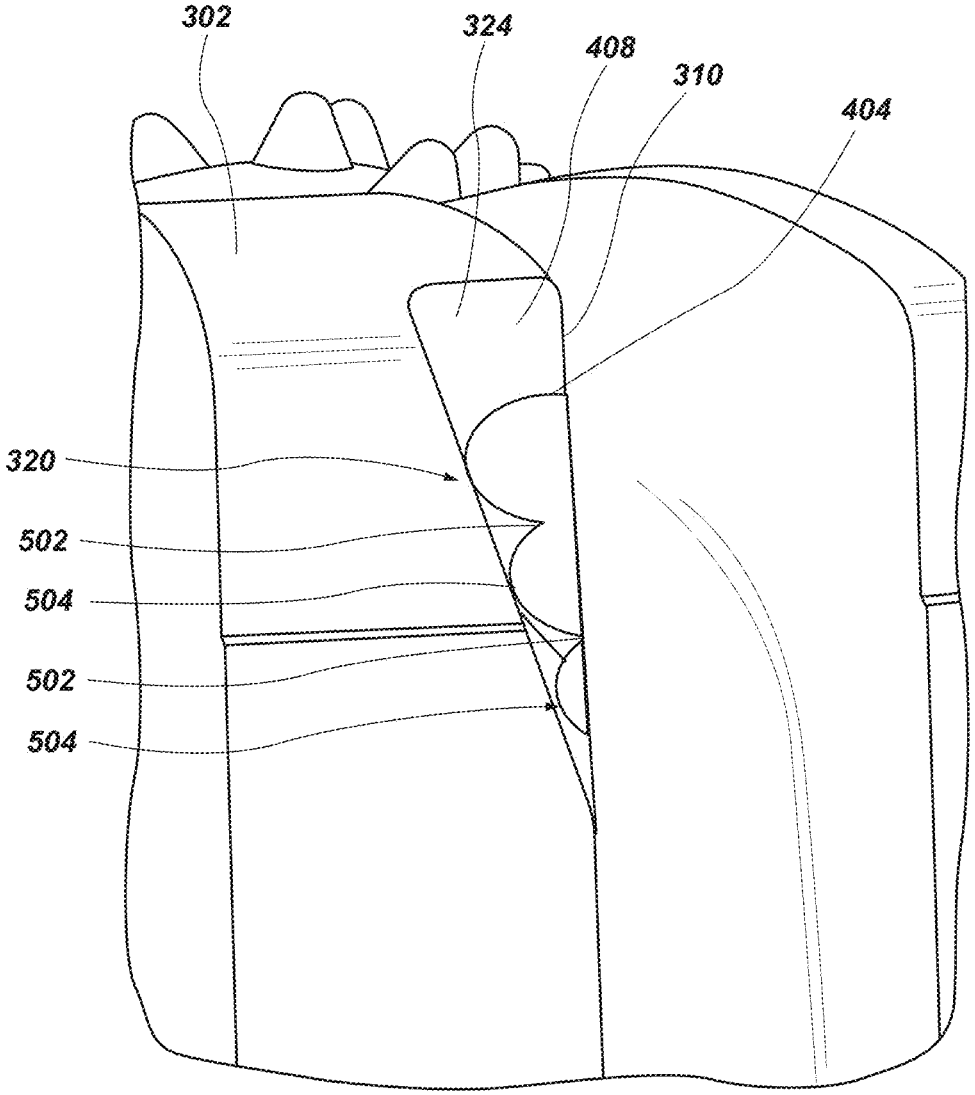
FIG. 5 illustrates an enlarged view of a shoulder region of the earth-boring tool of FIG. 4 in accordance with an embodiment of the present disclosure.

FIG. 5, illustrates an enlarged view of an embodiment of the shoulder region 312 of a blade 302 of the earth-boring tool 300. In some embodiments, the recess 320 may include multiple peaks 502 and valleys 504. The peaks 502 and valleys 504 may cause the surface of the recess 320 to not be smooth. The peaks 502 and/or valleys 504 may disturb the flow path of the fluid creating turbulence in the fluid flow. Turbulent flow may increase the velocity of at least some of the fluid. Thus, the peaks 502 and valleys 504 may increase the fluid flow velocity in the recess 320, which increased velocity may cause the fluid flow to clean and/or cool the cutting elements secured to the recessed shoulder cutter pockets 318 with more efficiency. Accordingly, forming the recess 320 to include one or more peaks 502 and/or valleys 504 may increase the cleaning and/or cooling efficiency of the fluid flowing into the recess 320.

In some embodiments, the recess 320 may be formed in the same process as the earth-boring tool 300 is formed, such as a molding or forging process. For example, the mold or form used to form the earth-boring tool 300 may include features corresponding to the recess 320 including features corresponding to the respective peaks 502 and valleys 504. In some embodiments, the recess 320 may be cut into the blade 302 after the earth-boring tool 300 is formed, such as through a machining process. For example, a plunge drilling operation may be used to form the peaks 502 and valleys 504. The plunge drilling operation may include multiple adjacent drill holes, wherein the peaks correspond to material between the drill holes and the valleys 504 correspond to the areas of the recess 320 at a center point of each drill hole along a plane parallel to the plane of the recess 320.

Figure 6:
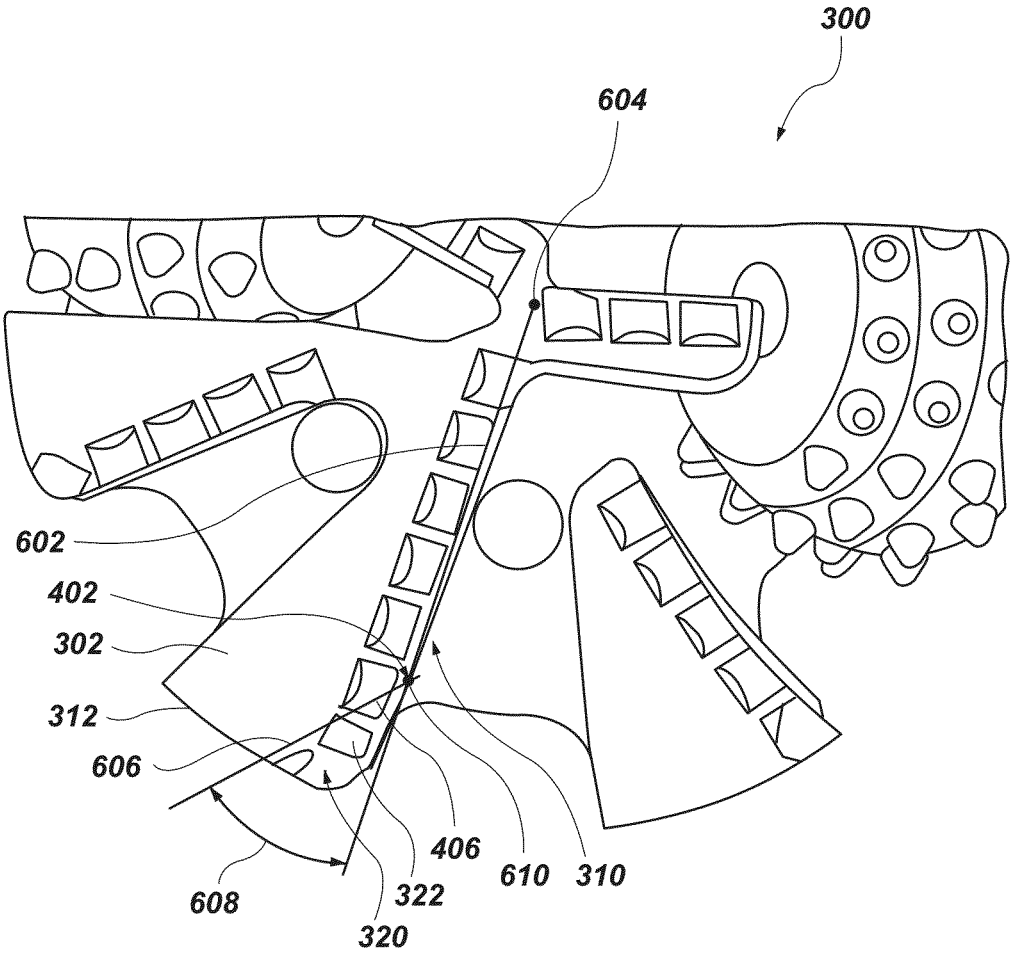
FIG. 6 illustrates a top view of the earth-boring tool illustrated in FIGS. 4-7 in accordance with an embodiment of the present disclosure.

FIG. 6 illustrates an enlarged top view of a portion of the earth-boring tool 300. The face 310 of the blade 302 may be substantially straight, such that the face 310 may substantially reside in a radial plane 602. The radial plane 602 may extend in a substantially straight line through the longitudinal axis 604 of the earth-boring tool 300. The recess 320 may substantially reside in a plane corresponding to a recess line 606 that extends at an angle 608 from the radial plane 602. The transition region 406 between the ledge 324 and the recess 320 may substantially follow the recess line 606. The angle 608 may be between about 10° and about 60°, such as between about 30° and about 50°, or about 43°.

The recess line 606 may intersect the radial plane 602 at an intersection point 610 between the longitudinal axis 604 of the earth-boring tool 300 and the shoulder region 312 of the blade 302. The intersection point 610 may correspond to the point where the transition region 402 between the recess 320 and the face 310 of the blade 302 intersects the transition region 406 between the ledge 324 and the recess 320. The intersection point 610 may be a point along the radial plane 602 that is more than halfway between the longitudinal axis 604 and the shoulder region 312 of the 402, such as between about five-eighths and about seven-eighths of the distance between the longitudinal axis 604 and the shoulder region 312, or about three-fourths of the distance between the longitudinal axis 604 and the shoulder region 312. For example, if the shoulder region 312 of the blade 302 is 6.125 in (155.575 mm) from the longitudinal axis 604, the intersection point 610 may be positioned between about 3 in (76.2 mm) and about 5.5 in (139.7 mm) from the longitudinal axis 604, such as between about 4 in (101.6 mm) and about 5 in (127 mm), or about 4.5 in (114.3 mm).

Figure 7:
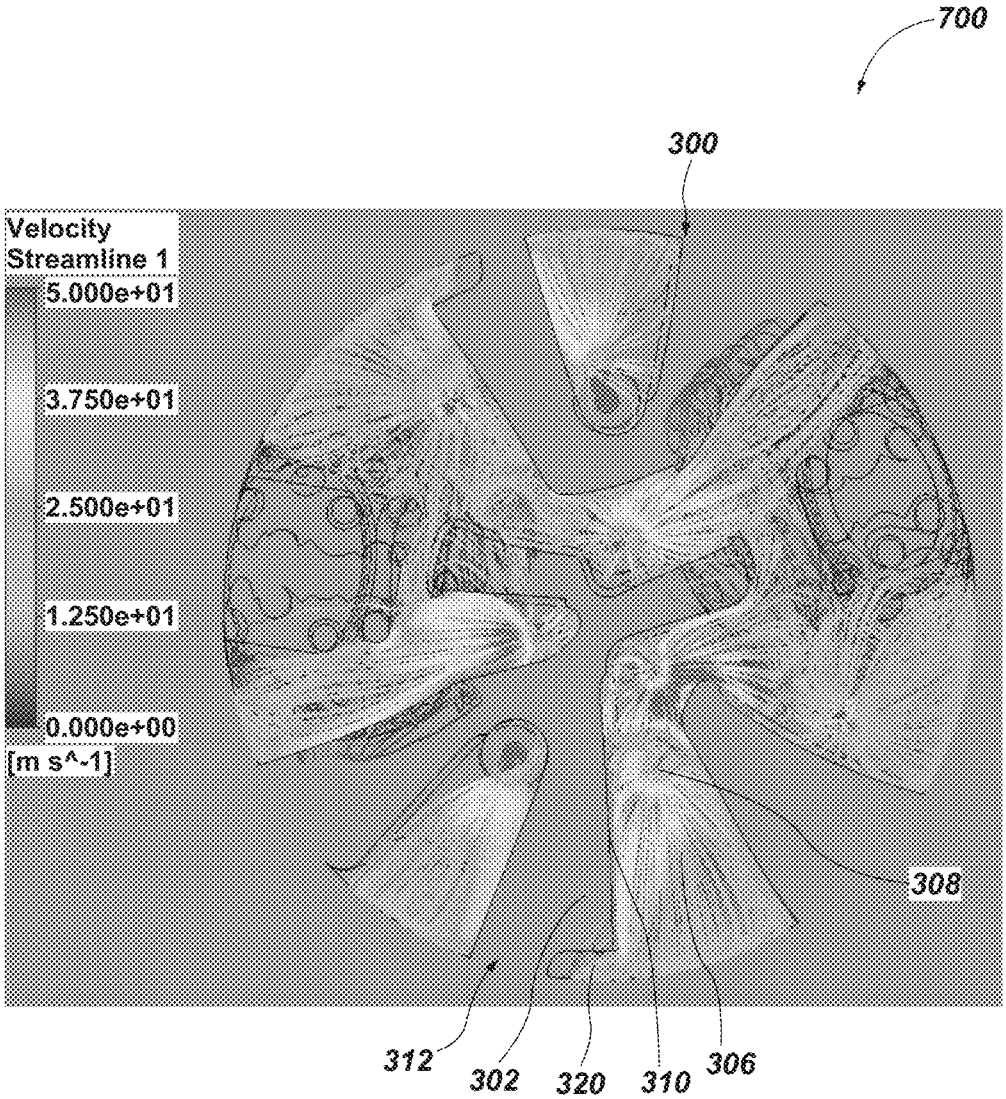
FIG. 7 illustrates a hydraulic flow diagram of the earth-boring tool illustrated in FIGS. 3-7 in accordance with an embodiment of the present disclosure.

FIG. 7 illustrates a flow diagram 700 of the earth-boring tool 300 of FIGS. 4-7. The flow diagram 700 illustrates flow of the fluid from the nozzles 308 into the junk slots 306. As illustrated in FIG. 3, the velocity of the fluid may be highest at the nozzle 308 and the velocity may dissipate as the fluid flow through the junk slots 306. In the higher velocity regions fluid may clear debris from around the elements of the earth-boring tool 300 substantially preventing premature wear due to debris build up. The higher velocity fluid may also dissipate heat from the elements of the earth-boring tool 300 substantially preventing premature wear and/or failure due to overheating.

The shape of the recess 320 may enable the fluid flow to maintain a higher flow velocity when compared to the flow diagram 200 (FIG. 2). As illustrated in FIG. 7, the fluid flow may maintain a relatively high flow velocity when entering the recess 320 and may circulate within the recess 320 before exiting the recess 320 through the junk slot 306. The relatively high flow velocity may provide improved cleaning and cooling for the cutting elements secured to the recessed shoulder cutter pockets 318.

Embodiments of the present disclosure may enable higher flow rates and/or flow velocities in the shoulder region of an earth-boring tool with recessed shoulder cutters. Increased flow rates and flow velocities may improve the cleaning and/or cooling of the recessed shoulder cutters. Improved cleaning and/or cooling may extend the life of the recessed shoulder cutters. Increasing the life of cutting elements on an earth-boring tool may extend the amount of time that the earth-boring tool may be used before the drilling assembly must be tripped out of the borehole to repair or replace the earth-boring tool. Many drilling operations operate at millions of dollars a day. Tripping out a drilling assembly may result in a loss of multiple days of productive work costing several millions of dollars. Furthermore, the loss of multiple days further delays the time before the wellbore may be finalized and become a productive profitable well. Thus, extending the time between trips may increase the profitability of the associated borehole.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are within the scope of this disclosure. Indeed, various modifications of the present disclosure, in addition to those shown and described herein, such as alternative useful combinations of the elements described, may become apparent to those skilled in the art from the description. Such modifications and embodiments are also within the scope of the appended claims and their legal equivalents.

What is claimed is:

1. An earth-boring tool comprising:

at least one blade comprising a shoulder region and a face;

a plurality of cutting elements arranged on the face of the blade;

at least three recessed shoulder cutting elements positioned in the shoulder region such that a cutting face of the at least three recessed shoulder cutting elements is spaced a distance behind the face of the blade; and a recessed portion of the blade extending under at least one of the plurality of cutting elements arranged on the face of the blade and extending to the at least three recessed shoulder cutting elements;

wherein the at least three recessed shoulder cutting elements are in a linear relationship at an angle between 20 degrees and 45 degrees relative to the face of the at least one blade.

2. The earth-boring tool of claim 1, further comprising a nozzle configured to discharge a fluid proximate the blade.

3. The earth-boring tool of claim 2, wherein the recessed portion is configured to direct the fluid to the at least three recessed shoulder cutting elements.

4. The earth-boring tool of claim 1, wherein the recessed portion comprises a triangular surface.

5. The earth-boring tool of claim 1, further comprising a transition region between the face of the blade and the recessed portion.

6. The earth-boring tool of claim 5, wherein the transition region comprises a rounded edge.

7. The earth-boring tool of claim 1, wherein the recessed portion extends at an angle from the face of the blade to the shoulder region of the blade.

8. The earth-boring tool of claim 7, wherein the angle is between 10° and 60°.

9. The earth-boring tool of claim 1, wherein the recessed portion comprises a curved surface.

10. An earth-boring tool comprising:

at least two blades extending from an earth-boring tool body:

a junk slot between the at least two blades;

one or more cutter pockets formed in a face of the at least two blades;

at least three shoulder cutter pockets formed in a shoulder portion of at least one of the at least two blades, the at least three shoulder cutter pockets formed a distance from the face of the at least one of the at least two blades, wherein the at least three shoulder cutter pockets are in a linear relationship at an angle between 20 degrees and 45 degrees relative to the face of the at least one of the at least two blades; and a recess connecting the at least three shoulder cutter pockets to the junk slot, wherein the recess extends under an outer cutter pocket of the one or more cutter pockets formed in the face of the at least two blades.

11. The earth-boring tool of claim 10, wherein the recess extends from a point in the face of the at least one of the at least two blades at least half the distance from a longitudinal axis of the earth-boring tool to the shoulder portion of the at least one of the at least two blades.

12. The earth-boring tool of claim 10, wherein the recess comprises a smooth surface.

13. The earth-boring tool of claim 10, wherein the recess comprises a surface including at least one peak.

14. The earth-boring tool of claim 10, further comprising a ledge extending over the recess.

15. The earth-boring tool of claim 14, wherein the ledge is configured to support the outer cutter pocket.

16. The earth-boring tool of claim 14, wherein the ledge comprises a thickness of at least 0.25 in (6.35 mm).

17. A method of forming an earth-boring tool comprising:

forming a tool body comprising one or more blades and cutter pockets defined in a surface of the one or more blades, wherein the cutter pockets are defined in at least a face of the one or more blades and a shoulder region of the one or more blades spaced a distance from the face of the one or more blades, at least three cutter pockets defined in the shoulder region having a linear relationship at an angle between 20 degrees and 45 degrees relative to the face of the at least one of the one or more blades;

forming a junk slot in an area of the tool body proximate the face of the one or more blades;

forming a nozzle within the junk slot configured to supply a fluid into the junk slot; and forming a recess extending at an angle from the face of the one or more blades to the at least three cutter pockets defined in the shoulder region of the one or more blades, wherein the recess is under at least one of the cutter pockets defined in the face of the one or more blades.

18. The method of claim 17, wherein forming the recess comprises machining the recess into the face of the one or more blades.

19. The method of claim 17, wherein forming the recess comprises plunge drilling the recess from the shoulder region of the one or more blades.

20. The method of claim 17, wherein forming the recess comprises forming the recess in a same process as forming the tool body.

* * * * *